US005145248A

United States Patent [19]

Chuan

[11] Patent Number: 5,145,248

[45] Date of Patent: Sep. 8, 1992

[54] STRUCTURE OF DECORATIVE NEON LIGHT

[76] Inventor: Chen W. Chuan, No. 32, Lane 169, Le Yeh Road, Taipei, Taiwan

[21] Appl. No.: 677,559

[22] Filed: Mar. 29, 1991

[51] Int. Cl.[5] ..... F21S 3/00

[52] U.S. Cl. ..... 362/217; 362/263; 362/810

[58] Field of Search ..... 362/217, 219, 263, 216, 362/260, 806

[56] References Cited

U.S. PATENT DOCUMENTS

| | | | |
|---|---|---|---|
| 2,061,824 | 11/1936 | Beymer | 362/810 |
| 4,088,882 | 5/1978 | Lewis | 362/217 |
| 4,679,126 | 7/1987 | Van Sickle | 362/806 |
| 4,800,473 | 1/1989 | Tremblay | 362/217 |

*Primary Examiner*—James C. Yeung

*Attorney, Agent, or Firm*—Lowe, Price, LeBlanc & Becker

[57] ABSTRACT

A neon light is disclosed which consists of a neon tube having an electrode at either end and a conductive thread extending from each electrode. The tube is retained within a plastic outer shell and a cap is placed on one end covering the electrode. The opposite end is received within a light shade which covers the electrode and which mounts opposed copper electrodes on opposite sides thereof. The conductive threads extend through the plastic surrounding shell into the light shade and are coupled to the copper electrodes. The light at the shade end is then received within a socket of a pedestal wherein the side electrodes are received within internal tracks and when seeded engage electrodes within the socket. The socket then has an external threaded portion which may be mounted on a pedestal by a ring nut and has tenon members on opposite sides thereof which retain the shade received therein by engaging a surrounding flange thereon.

2 Claims, 3 Drawing Sheets

STRUCTURE OF DECORATIVE NEON LIGHT

BACKGROUND OF THE INVENTION

For a traditional neon light, the electricity-emission of the light tube is done by pipe-shaped electrode heads, which are on the two ends of a glass tube. The glass tube covers the electrode. At one end of the tube conductive thread extends through the tube and air within the tube is evacuated. The evacuated tube is filled with inert gas and mercury, and this is the structure of a conventional neon light.

The above mentioned neon light can shed beautiful and soft light, but the electrode heads on the light's two ends cannot be concealed. Moreover, they do not shed light. So when neon light is viewed from a short distance, it is ugly. Traditional neon light tubes cannot be connected to electricity on one of its ends as with a light bulb. Therefore, neon light can only be installed in specially-designed space. It cannot be used on decorative lighting equipment.

It is true that neon light has several merits, such as various colors and soft light. And when it is produced, it can be easily bent. In addition to that, it can be used as advertising sighboard outdoors. Indoors, it can be used as trademark or special identification pattern. Yet, the shortcoming of neon light greatly lessens its function. That disadvantage leaves the present neon light some space to be improved.

Aiming to overcome the disadvantage of neon light, this invention is thus motivated and formed. It offers an improved structure of the decorative neon light. This invention can conceal the unpleasant electrode heads with a covering cap and a light shade. At the same time, the conducting thread from electrodeheads can be extended through the round-tubed light shade. The conducting thread can be concealed between the neon light tube and plastic surrounding tube as well as between the neon light tube and the light shade.

This kind of arrangement helps overcome the unsafe problem of a traditional neon light. Neon light tube of this invention is easily changeable. It is a more complete one with a light shade. Through light shade, the light tube can be put on a pedestal of a decorative light. This kind of design can form a single or a set combination of neon light, which is creative one neon light.

SUMMARY OF THE INVENTION

This invention is consist of a covering cap, a plastic round tube, a neon light tube, a round-tubed light shade, a pedestal and a nut.

On light tube, there covers a plastic tube. And the upper and lower ends of covering tube are connected with covering cap and light shade in order to hid the electrode heads. The conducting thread of electrode head goes down along the space between light tube and plastic round tube to the lower electrode head. The upper and lower conducting threads of electrode head are in the light shade at the same time. These two conducting threads are separately connected with the electricity-conducting copper piece.

Therefore, when the light of this invention is mounted on a pedestal electrodes therein conduct electricity through copper pieces to the conducting threads. Thus, a beautiful and new-styled decorative light is formed. Assembling the components is equally easy as taking them apart.

DETAILED DESCRIPTION OF THE PREFERRED EMBODIMENTS

Figure 1:
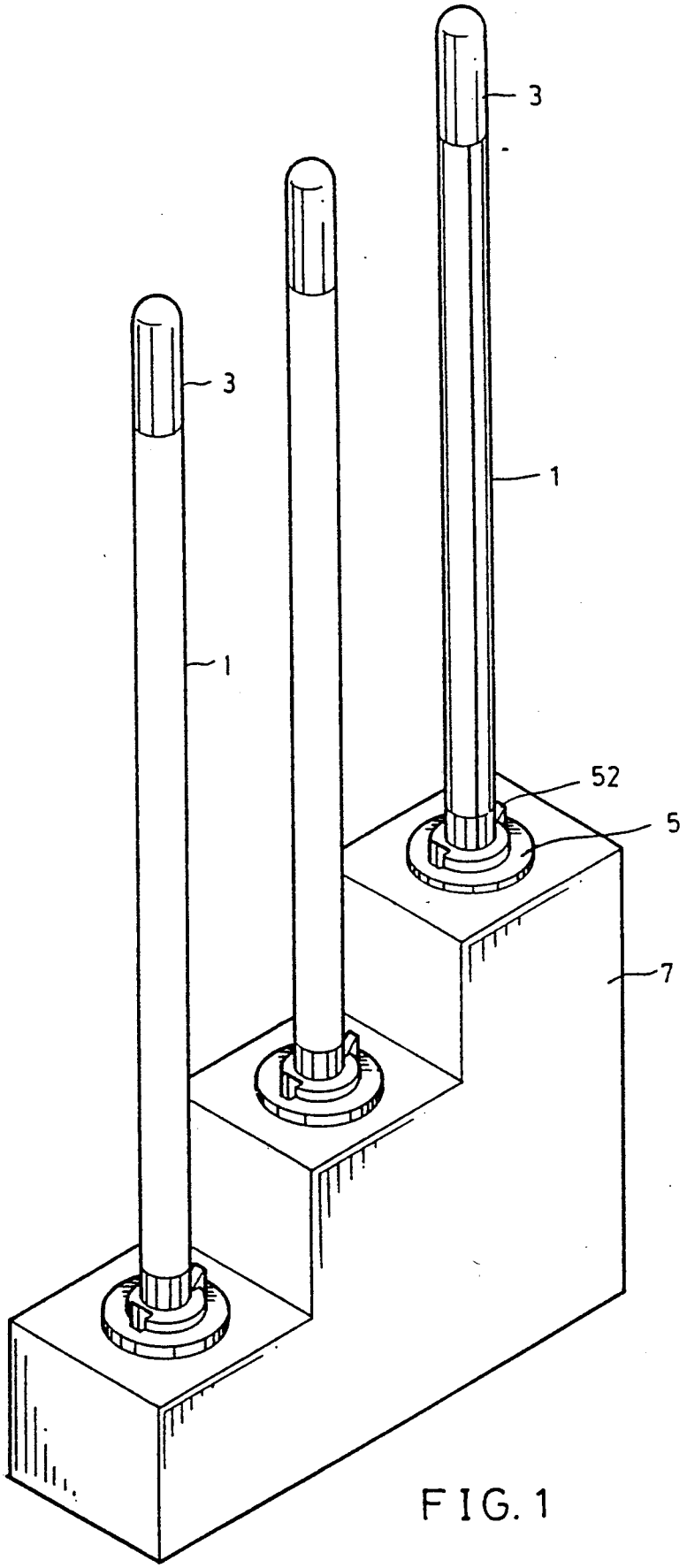
FIG. 1. A perspective drawing, presenting the embodiment of the invention.
Figure 2A:
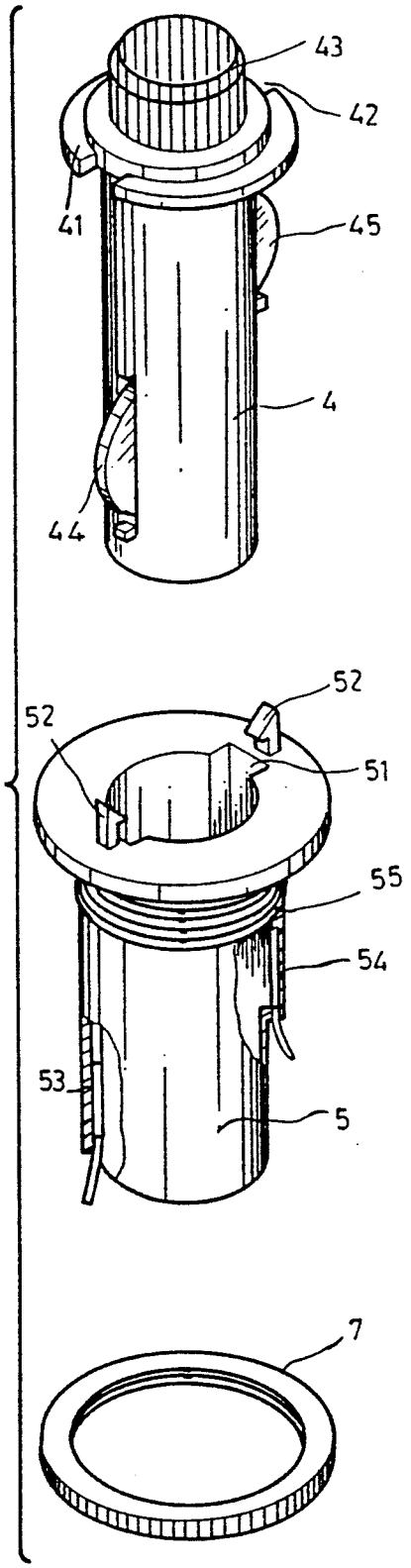
FIG. 2A is a perspective exploded view of the socket mounting of the light of this invention.
Figure 2B:
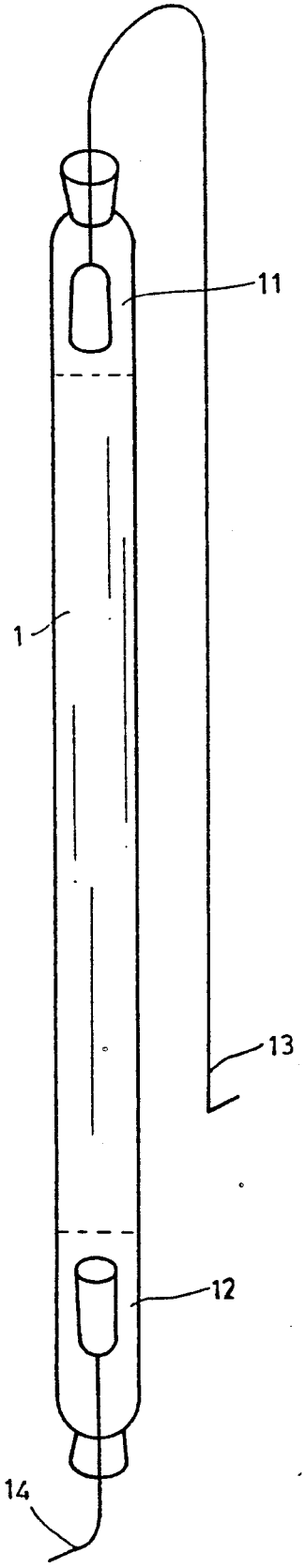
FIG. 2B is a side view of the neon bulb of this invention.
Figure 2C:
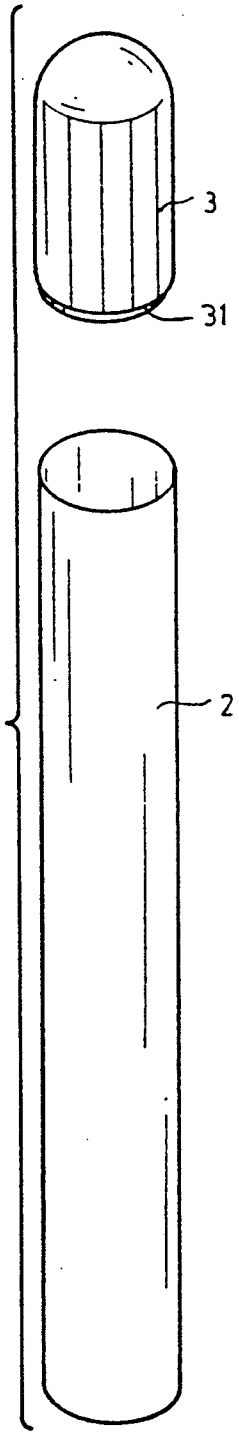
FIG. 2C is an exploded view of the light surrounding tube and cap of this invention.
Figure 3:
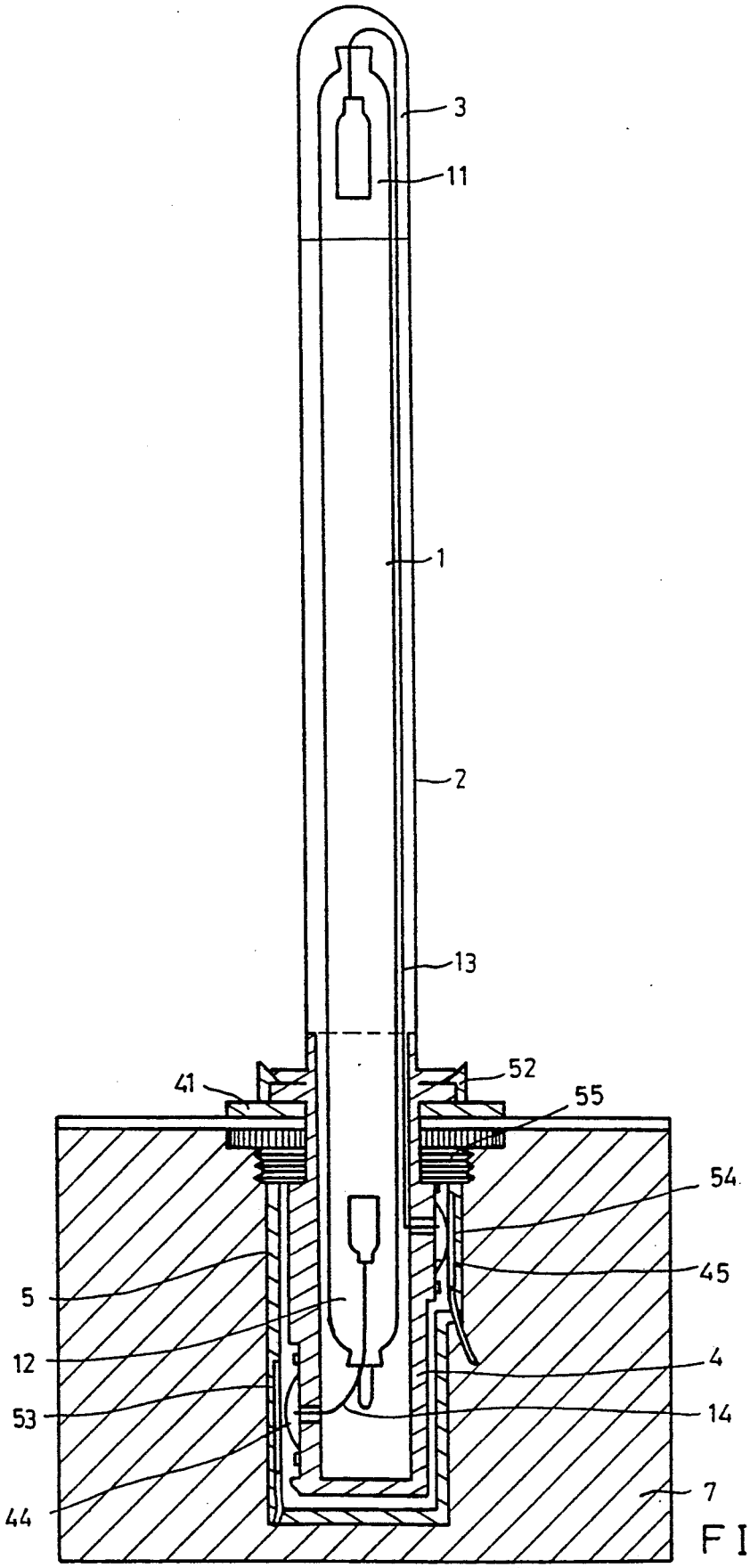
FIG. 3 is a side view of the device of this invention in partial cross section.

Referring to FIGS. 1 through 3:

FIG. 1 shows a whole set of decorative neon light. Its components include a neon light tube (1), a plastic light tube (2), covering cap (3), round-tubed light shade (4), light pedestal (5), and a nut (7).

There are electrode heads (11), (12) on the two ends of neon light tube (1). And each electrode head (11), (12) draws a conducting thread (13), (14).

Plastic round tube (2) covers on neon light tube (1). It is located between two electrode heads of light tube. So that the conducting thread (13) of electrode head can go down through the space between plastic round tube (2) and neon light tube (1).

Covering on neon light tube, the covering cap (3) is outside the electrode head. When the lowered end (31) of covering cap (3) is put in the plastic tube (2) and, they can stick together tightly. Therefore, the electrode head (11) can be concealed.

On the two opposite sides of flange (41) of the round-tubed light shade (4), there are two indentions (42). And the upper ring (43) is disposed above them. Under them, there are two jutting parts (44), (45) which are electricity conducting copper pieces. Light shade (4) receives an end of light (1) containing electrode (12) and the ends of conducting threads (3) and (14). threads (13), (14) are connected with copper pieces (44), (45). The upper ring (43) of the light shade (4) is received within the end of plastic round tube (2). All these arrangements form a neon light tube, whose feature is the accompanied light shade.

Light pedestal (5) is fixed on the decorative light equipment. On the two sides of pedestal (5), there are rails (51) and tenons (52). And inside pedestal (5), there are two copper electrodes (53), (54). When neon light tube is put onto the pedestal (5) through the round-tubed light shade, the copper pieces (44), (45) of light shade extend into pedestal (5) and smoothly touch the copper pieces (53), (54) of pedestal (5) along the rail (51). These two are tightly put together through the combination of tenon (52) and the ring (41) of light shade. In order to fix pedestal (5) on the decorative light, light shade (4) and the threaded section (55) are locked together with nut (7) as shown in FIG. 3.

In this invention, width of the jutting parts (44) and (45), which are on the two sides of round-tubed light shade (4), is different corresponding to the slots (51), which are on the two sides of pedestal. The purpose of this special design is to ensure a correct combination of the set arrangements. It can also prevents copper pieces (44), (45) from being reversed in conducting rails (51). Other problems are able to be prevented too.

Neon light tube inlays the tenon (52) with the ring (41) of light shade (4) in order to retain the light shade (4) in said pedestal (5). This arrangement also ensures the safety of neon light tube, especially for a hanging neon light tube.

Neon light tube (1), plastic round tube (2), covering cap (3) and round-tubed light shade (4) form this invention—a neon light tube with a light shade.

As an emitting subject, it can easily be connected with a pedestal of a decorative light. The design of this kind of set combination is very creative. In apart from that, the number of neon light tubes can be changed according to individual need. With its practical function, the value of this invention is predictable. There is no similar product known.

I claim:

1. A decorative neon light comprising a sealed glass tube, an electrode mounted at either end of the tube and conductive threads extending outwardly from the electrodes through sealed ends of the tube;

a plastic cylinder surrounding the tube, said threads received within the cylinder and a plastic cap mounted on an end of the cylinder surrounding one electrode in the tube;

a mounting sleeve receiving the end of the tube opposite the end adjacent said cap, said sleeve having opposed outwardly extending electrodes, each coupled to one of the threads, an end of said sleeve mounting an end of the cylinder opposite the end mounting said cap and an external flange surrounding at least a portion of the end of said sleeve adjacent the mounted end of said cylinder;

a socket dimensioned to releasably receive said sleeve electrode means within said socket for engaging the electrodes on said sleeve and said socket defining opposed slots for receiving said sleeve electrodes and means on said socket for releasably engaging the flange on said sleeve.

2. The light of claim 1 further comprising a pedestal having a hole therein dimensioned to receive said socket, said socket having a mounting flange dimensioned to engage the pedestal surrounding the hole and threaded nut means mounted on the socket for retaining the same of said pedestal.

* * * * *